US005997450A

United States Patent [19]

Wilkinson

[11] Patent Number: 5,997,450

[45] Date of Patent: Dec. 7, 1999

[54] COMBINATION SLANT BOARD AND ABDOMINAL ROCKER

[76] Inventor: William T. Wilkinson, P.O. Box 73, Salem, N.J. 08079

[21] Appl. No.: 09/063,579

[22] Filed: Apr. 21, 1998

Related U.S. Application Data

[63] Continuation-in-part of application No. 08/710,510, Sep. 18, 1996, Pat. No. 5,674,168

[60] Provisional application No. 60/044,196, Apr. 25, 1997, Pat. No. 5,839,998.

[51] Int. Cl.[6] ..... A63B 21/00

[52] U.S. Cl. ..... 482/142; 482/72; 482/92; 482/95; 482/96; 482/121; 482/122; 482/123; 482/129; 482/130; 482/140; 482/148; 601/23; 601/24; 601/33

[58] Field of Search ..... 482/72, 92, 95, 482/96, 100, 121–123, 129, 130–133, 135–140, 142, 148, 908; 601/23, 24, 26, 33; D21/686–690

[56] References Cited

U.S. PATENT DOCUMENTS

| | | |
|---|---|---|
| 5,080,352 | 1/1992 | Freed . |
| 5,100,130 | 3/1992 | Shoebrooks . |
| 5,120,052 | 6/1992 | Evans . |
| 5,160,304 | 11/1992 | Van Der Hoeven . |
| 5,181,895 | 1/1993 | Larson et al. . |
| 5,190,513 | 3/1993 | Habing . |
| 5,256,126 | 10/1993 | Grotstein . |
| 5,300,005 | 4/1994 | Wang . |
| 5,368,537 | 11/1994 | Felice . |
| 5,403,258 | 4/1995 | Hill . |
| 5,441,472 | 8/1995 | Johnston . |
| 5,492,520 | 2/1996 | Brown . |
| 5,518,487 | 5/1996 | Hallmark . |
| 5,542,898 | 8/1996 | Wilkinson . |
| 5,545,114 | 8/1996 | Gvoich . |
| 5,577,987 | 11/1996 | Brown . |
| 5,584,786 | 12/1996 | Almeda . |
| 5,591,111 | 1/1997 | Wang et al. . |
| 5,611,765 | 3/1997 | Koch, Jr. . |
| 5,616,109 | 4/1997 | Szu-Ming . |
| 5,630,778 | 5/1997 | Barreca . |
| 5,632,710 | 5/1997 | England et al. . |
| 5,674,168 | 10/1997 | Wilkinson . |
| 5,697,874 | 12/1997 | Abelbeck . |

FOREIGN PATENT DOCUMENTS

| | | |
|---|---|---|
| 38 12542 | 10/1989 | Germany . |
| 4307632 | 9/1993 | Germany . |

OTHER PUBLICATIONS

Nordic Track Spring 1995 Catalog, p. 28.

*Primary Examiner*—Richard J. Apley
*Assistant Examiner*—Lori Baker-Smith
*Attorney, Agent, or Firm*—Connolly Bove Lodge & Hutz LLP

[57] ABSTRACT

A combination slant board and abdominal rocker includes a slant board which comprises a rigid body support elevated at one end to incline the body support. The abdominal rocker has a frame with a base section pivotally mounted adjacent to the body support and a grip section spaced from the base section. A neck rest is mounted to the frame between the base section and the grip section. The grip section and the neck rest are located above the body support.

14 Claims, 9 Drawing Sheets

46
14
38
12
10
30
44
39
22
26
28
34

46
56
58
54
54
44
48
40
18
12
50
30
28
52
22
24
16
42
39
38
36
20
20

32
46
60
44
48

32
46A
34A
60
44

COMBINATION SLANT BOARD AND ABDOMINAL ROCKER

CROSS-REFERENCE TO RELATED APPLICATION

This application is a continuation in part of Ser. No. 710,510, filed Sep. 18, 1996 U.S. Pat. No. 5,674,168. This application is also based on provisional application 60/044,196, filed Apr. 25, 1997, now U.S. Pat. No. 5,839,998.

BACKGROUND OF THE INVENTION

Two major devices are available which develop abdominal muscles. One of the devices is a slant board or bench and the other is an abdominal rocker. Each of the devices has advantages and has drawbacks. The slant board has no neck support, provides no rocking action and has no arm or hand support and the exercise is not done on a horizontal surface. The rocker is done on a horizontal surface and has no angle adjustability to add resistance from gravity. The rocker also has no padding beneath the user, no place to anchor the feet and is prone to lateral or side to side instability.

SUMMARY OF THE INVENTION

An object of this invention is to provide a combination exercise device which combines the features of both the slant board and the abdominal rocker into a single device to incorporate the respective advantages while minimizing the problems attendant with each.

A further object of this invention is to provide such a combination exercise device which permits each of the components to be used individually when desired.

In accordance with this invention a combination exercise device includes a slant board and an abdominal rocker. The slant board comprises a rigid body support which is preferably padded and is elevated at one end to incline the body support. The abdominal rocker includes a frame having a base section pivotally mounted adjacent to the body support with a grip section spaced from the base section. A neck rest is mounted to the frame between the base section and the grip section with the grip section and neck rest being located above the body support so that the user can lay on the body support with the neck or head on the rest and the hands or arms at the grip section.

In a preferred practice of this invention the abdominal rocker is mounted to the slant board in one of a number of selected different positions. Preferably, the mounting is in a detachable manner so that the slant board and abdominal rocker could be used independently of each other when desired.

In other practices of this invention various other types of exercise components may be included in the combination. Such components could include, for example, rowing arms, elastic cords and weights. An abdominal flex device might also be included on the abdominal rocker. The abdominal rocker might be adjustable in width to accommodate different size slant boards.

THE DRAWINGS

DETAILED DESCRIPTION

Figure 2:
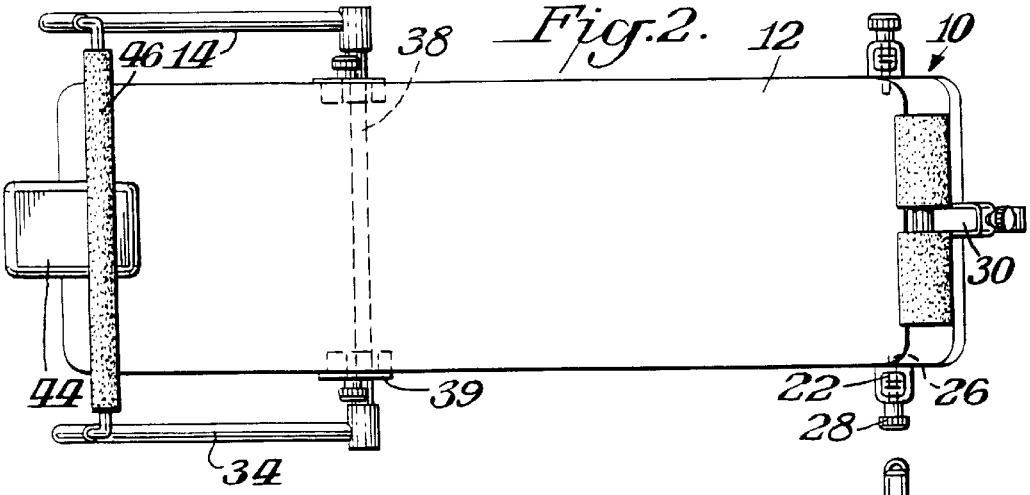
FIG. 2 is a top plan view of the device shown in FIG. 1.
Figure 1:
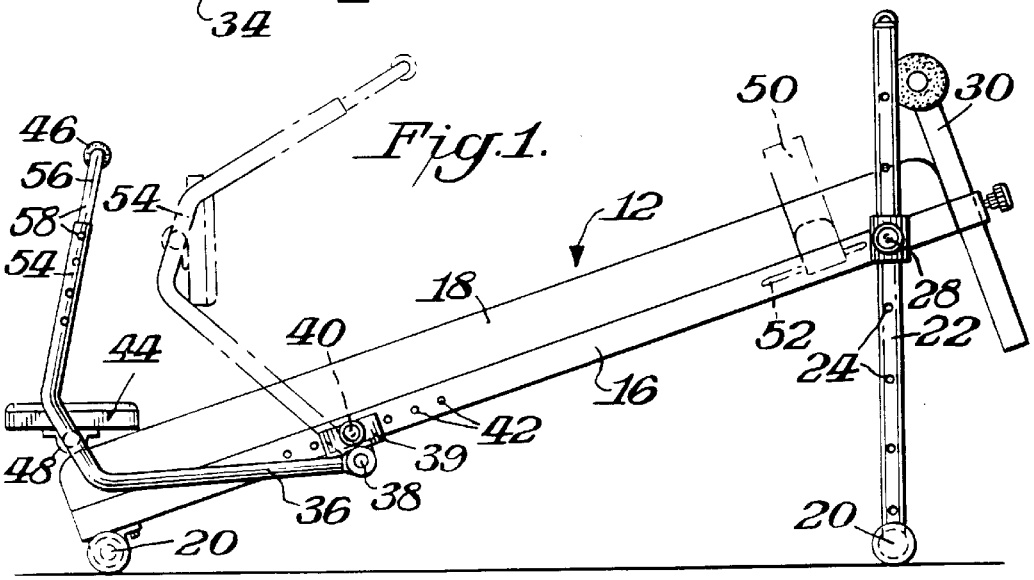
FIG. 1 is a side elevational view of a combination exercise device in accordance with this invention.
Figure 3:
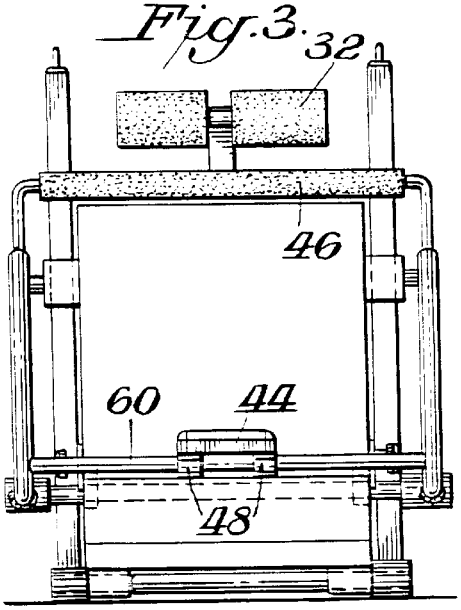
FIG. 3 is a left end elevational view of the device shown in FIGS. 1–2.

FIGS. 1–3 show a combination exercise device 10 in accordance with this invention. In general, exercise device 10 includes a slant board or bench 12 and an abdominal rocker 14. The invention may be broadly practiced with various forms of slant boards and various forms of abdominal rockers. In this respect, the invention in its broad form is based upon the combination of the two exercise units into a single exercise device.

In the embodiment shown in FIGS. 1–3 slant board 12 includes a rigid body support 16 which is completely covered by padding 18. A stabilizing member 20, such as a rod having high friction material covering the rod is located at one end of slant board 12. The opposite end of slant board 12 is elevated by a mounting structure which includes upright posts 22 having a plurality of spaced holes 24 into which a lock pin 26 would be selectively inserted by the pulling outward or pushing inward of knob 28. A further stabilizing member 20 is connected to the bottom of posts 22. The structure for slant board 12 and the manners of adjustment may take the forms shown and described in copending application Ser. No. 480,645, filed Jun. 7, 1995, now U.S. Pat. No. 5,674,168 all of the details of which are incorporated herein by reference thereto. Thus, the various details in Ser. No. 480,645, now U.S. Pat. No. 5,674,168 may be incorporated to enhance the use of the slant board either as a separate exercise device or in combination with the abdominal rocker.

As also shown in FIGS. 1–3 a post member 30 is adjustably secured to the elevated end of slant board 12. A padded cross-member 32 extends outwardly from the exposed upper end of post 30 for engagement with the user's feet or hands in accordance with the particular exercise being done.

If desired, slant board 12 may also incorporate various structural elements to enhance the types of exercises that could be done by utilizing various components disclosed in applicant's copending application Ser. No. 689,056 filed Jul. 30, 1996, now U.S. Pat. No. 5,810,702, all of the details of which are incorporated herein by reference thereto. In this respect, such copending application discloses a platform having, for example, a bench with various other components associated therewith. The bench might be considered as a form of slant board or exercise platform and the associated components described in the copending application may be included in the practice of this invention.

Abdominal rocker 14 is shown in FIGS. 1–3 as including a frame 34 which is of symmetrical construction in that each side of the frame and the various components thereof is identical to the other side. Frame 34 includes a base section 36 which is pivotally mounted adjacent to the rigid body support 16. This is accomplished by providing a rod 38 which extends from one side of the frame to the other and is located below support 16. A bracket 39 is secured to the rod on each side of support 16 with a pin, such as a spring pin 40 extending into one of a corresponding set of holes 42 in support 16. Thus, the mounting of the pins 40 to the support 16 permits the user to lay on padding 18 and rock the frame 34 in a known manner. Such rocking action would be achieved while the head and/or neck of the user is disposed on neck rest 44 and while the user's hands or arms are at padded grip member 46 which extends across frame 34. If desired, neck rest 44 may be swively mounted to cross bar 60 as shown at swivel mounting 48 to permit the neck rest to be pivoted, for example, 900 or otherwise disposed to an inactive condition during various exercises.

Although the embodiment of FIGS. 1–3 show the adjustable mounting to be accomplished by the series of holes 42, other means could be used for varying the location of mounting. For example, the upper surface of the slant board 12 or some longitudinal attachment on each side of the slant board having a series of spaced grooves, recesses or dimples in which a post, pin or rod on the base section 36 may be selectively inserted.

An advantage of utilizing rocker 14 in combination with slant board 12 is that the user's feet may engage the cross member 32 or, for example, the strap 50 shown in phantom in FIG. 1. As shown strap 50 extends through slots 52 in support 16 and is located over and across padding 18.

A further feature of rocker 14 is that grip section 46 may be adjusted in its elevation. Thus, for example, as best shown in FIG. 1 frame 34 includes outer tubing 54 and inner tubing 56 telescoped therein with spring pins or other fasteners selectively determining the amount of extension of outer tubing 56 from inner tubing 54 by engagement, for example, of a spring pin in one of a number of selected holes 58.

Figure 4:
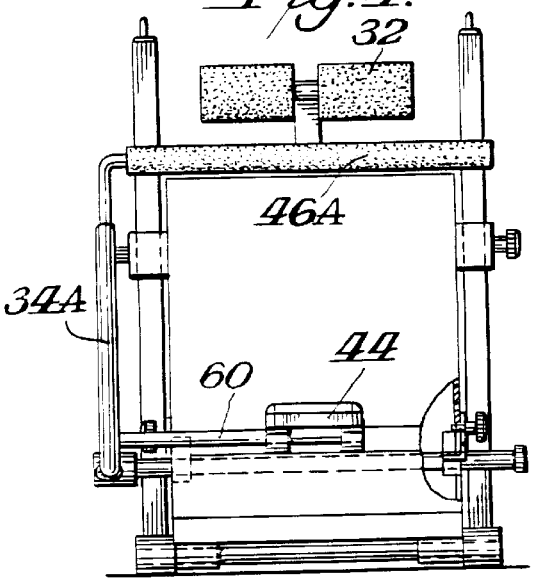
FIG. 4 is a left end elevational view similar to FIG. 3 of a modified form of device.

FIG. 4 shows an alternative form of rocker wherein the frame 34A is located on only one side of the slant board. Thus, as shown therein the grip section 46A is cantilevered extending only from one side of frame 34A.

As illustrated, neck rest 44 is mounted on cross bar 60 which is part of frame 34. Preferably the neck rest 44 is permanently mounted at the center of cross bar 60. Where, however, a swivel mechanism 48 is provided to permit the headrest to be moved out of its active position, the invention may also be practiced by permitting the neck rest to slide along cross bar 60 to further move the neck rest to an inactive position. In the embodiment shown in FIG. 4 where the neck rest is mounted on cantilevered cross bar 60 the neck rest could be completely slid off cross bar 60 and thus removed during its inactive position.

Figure 5:
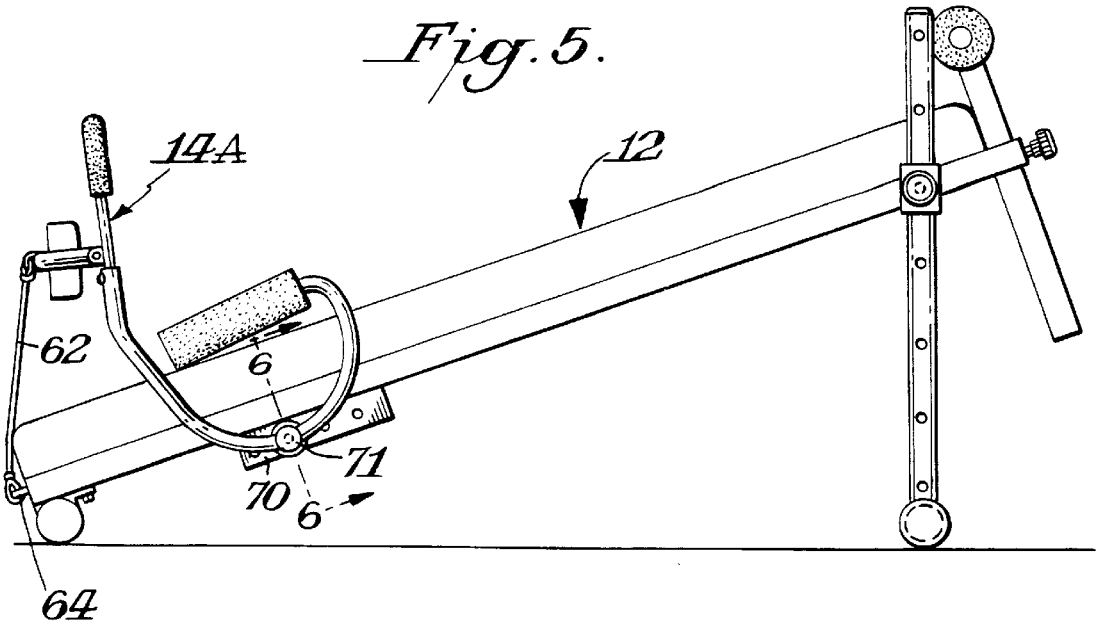
FIG. 5 is a side elevational view of yet another form of combination exercise device in accordance with this invention.
Figure 6:
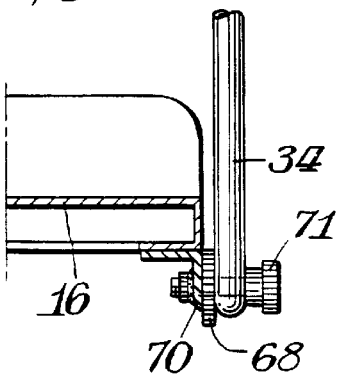
FIG. 6 is a cross-sectional view taken through FIG. 5 along the line 6—6.

As noted, the invention may be practiced with any suitable form of slant board or abdominal rocker. FIGS. 5–6 show, for example, an abdominal rocker having the general type of structure illustrated and described in U.S. Pat. No. 5,492,520, all of the details of which are incorporated herein by reference thereto. Such form of abdominal rocker 14A could, however, be modified to include a resistance cord 62 anchored at C-hook 64 at one end and anchored to neck rest loop 66 at its other end, thus providing some resistance during the rocking action.

FIG. 6 illustrates additional details which could be utilized with the present invention. As shown therein, the rocking action could be adjusted by incorporating an adjustable friction brake mechanism 68 between frame 34 and bracket 70 mounted to support 16. Reference is made to U.S. Pat. No. 5,460,586 for details of a suitable friction brake mechanism. All of the details of U.S. Pat. No. 5,460,586 are incorporated herein by reference thereto. The degree of frictional resistance would be controlled by the rotating of lock knob 71. A friction resistance mechanism can be incorporated in any of the embodiments where appropriate.

Figure 7:
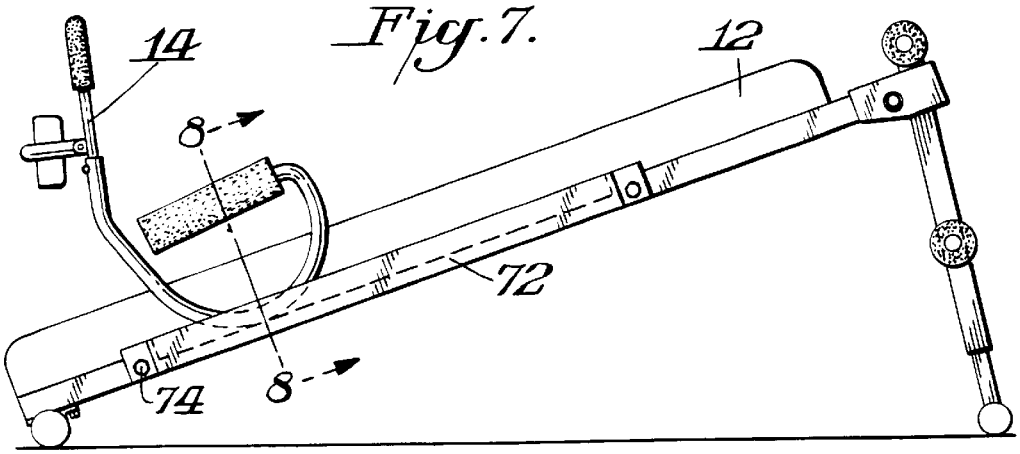
FIG. 7 is a side elevational view of still yet another form of combination exercise device in accordance with this invention.
Figure 8:
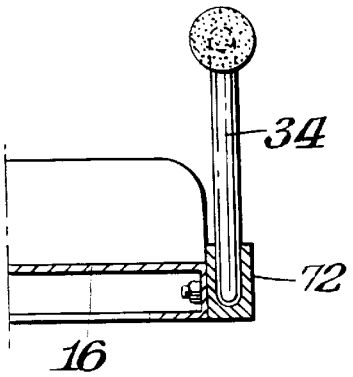
FIG. 8 is a cross-sectional view taken through FIG. 7 along the line 8—8.

FIGS. 7–8 illustrate an alternative manner of adjustably and detachably mounting rocker 14 to slant board 12. As shown therein a channel member 72 is secured to each side of support 16 to provide a track on each side of the support 16. Channel 72 may be secured in any suitable manner such as by bolts 74 at each end of the channel member. Frame 34 is dimensioned to fit into the channel 72 and thus the channel acts as a track to permit a rocking action of rocker 14 in the known manner.

Figure 10:
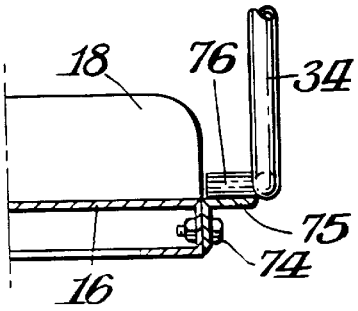
FIG. 10 is a cross-sectional view taken through FIG. 9 along the line 10—10.
Figure 9:
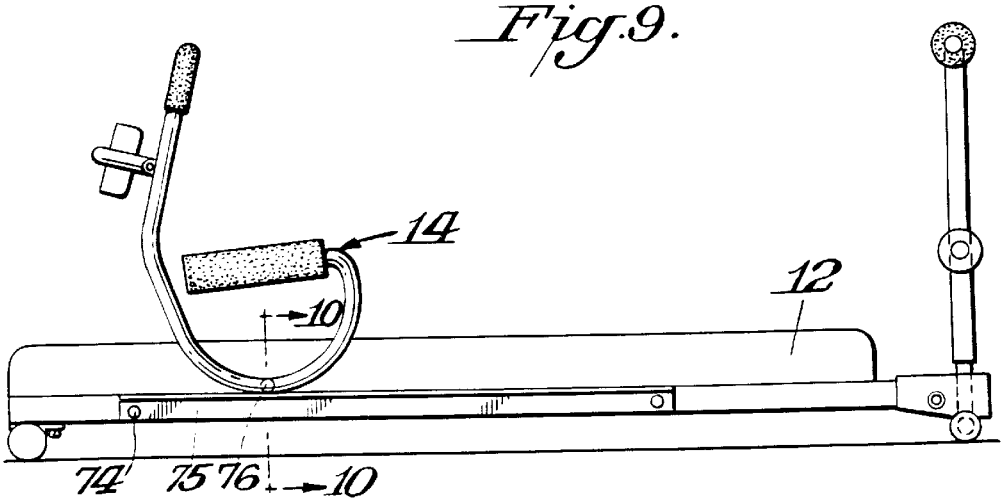
FIG. 9 is a side elevational view of still yet another form of combination exercise device in accordance with this invention.

FIGS. 9–10 illustrate yet another form of detachable mounting of rocker 14 to slant board 12. As shown therein a pin or post 76 extends inwardly from each side of frame 34 and simply rests on the padding 18 of support 16 or preferably on an L-shaped bracket 75 on each side of support 16. In this embodiment the rocker 14 could roll up or down the slant board similar to the use of tracks 72.

FIGS. 9–10 also show a practice of the invention where the slant board 12 is completely horizontal. The form of mounting illustrated therein, however, may also be practiced where there is an inclination to the slant board since the user's weight would tend to maintain the rocker in place. Similarly the slant board of other embodiments may be horizontal.

Figure 11:
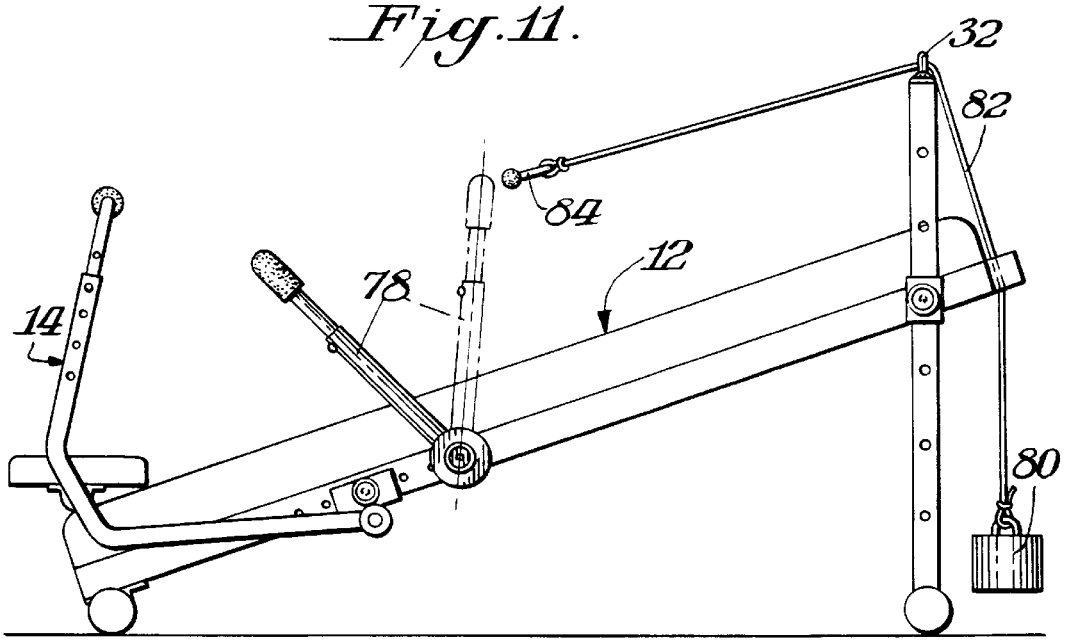
FIG. 11 is a side elevational view of still yet another form of combination exercise device in accordance with this invention.

The invention may be practiced by enhancing the exercises possible through the use of additional exercise or resistance components. FIG. 11, for example, shows the inclusion of rowing arms 78 mounted to each side of slant board 12. Reference is made to copending application Ser. No. 480,645, now U.S. Pat. No. 5,674,168 for details of such rowing arms.

In addition, FIG. 11 shows the provision of at least one weight 80 mounted to a non-elastic cord 82 with one or two loops 84 at the other end through which the user's arms or legs would be placed with the cord 82 extending over cross piece 32 or around a pulley on cross piece 32. Alternatively, a weight could be secured to the arms 78 or the rocker 14.

Figure 13:
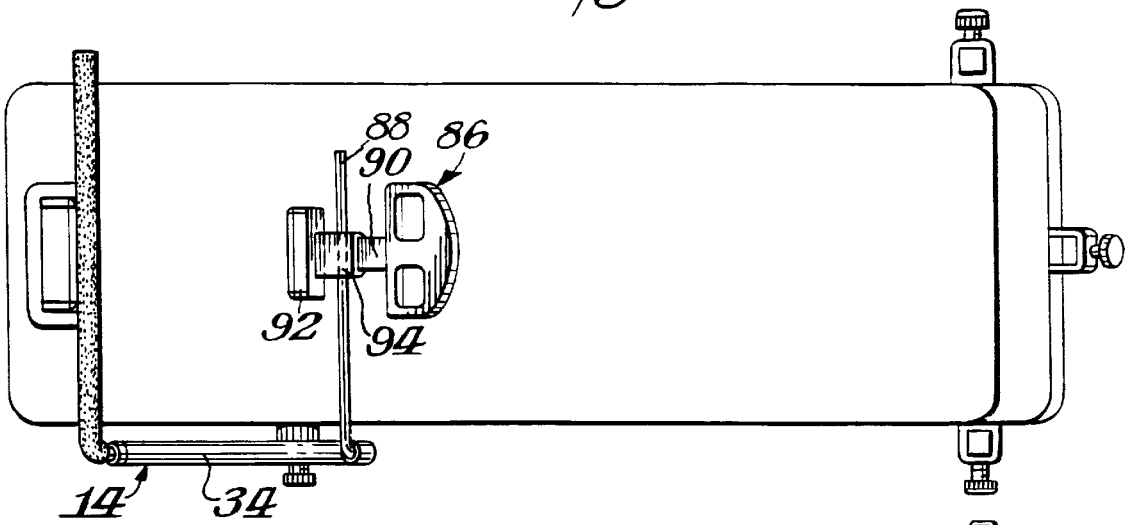
FIG. 13 is a top plan view of the device shown in FIG. 12.
Figure 12:
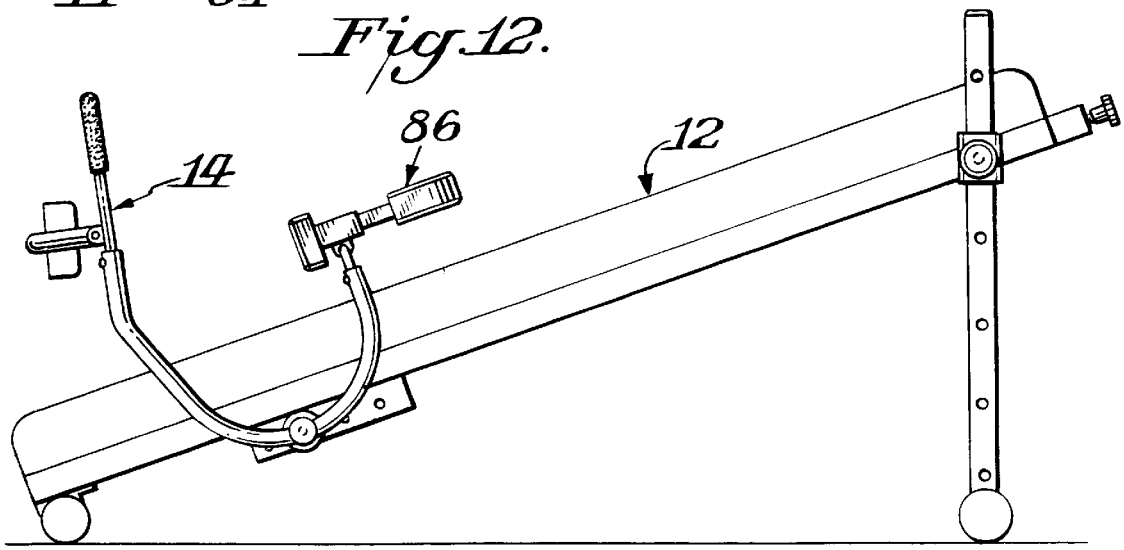
FIG. 12 is a side elevational view of a further form of combination exercise device in accordance with this invention.

FIGS. 12–13 show a modification of rocker 14 which represents a distinct departure from the prior art and in itself is a novel form of rocker. As shown therein the rocker 14 includes a device 86 held in the hand or mounted on the legs, but placed directly on the abdomen. Such device 86 incorporates a resistance mechanism to develop the midsection. Device 86 might thus be considered as an abdominal flex device. Basically, the rocker 14 would have the same type of structure previously described but would also include the abdominal flex device 86 which comes in contact with the abdomen. In the illustrated form the abdominal flex component 86 includes a bar 88 that is mounted to frame 34. A centrally mounted outer member 90 is secured to rod or bar 88 extending toward the abdomen. An inner member or shaft 94 is slidably mounted in outer member 90. Alternatively, member 94 may slide along side of member 90. Inner member 94 terminates in a padded abdomen contacting member 92 extending across inner member 94. As best shown in FIG. 13 padded member 92 is urged into contact with the abdomen by some adjustable resistance mechanism such as a spring mounted within outer member 90 and disposed against inner member 94. Thus, when the user rocks forward, varying degrees of resistance would apply to the abdominal muscles. The normal extension of inner member or shaft 94 from outer member 90 could be located at different positions to bring it closer to or further from the abdomen, to exert greater or lesser pressure on the midsection and to benefit people of different sized midsections.

Figure 14:
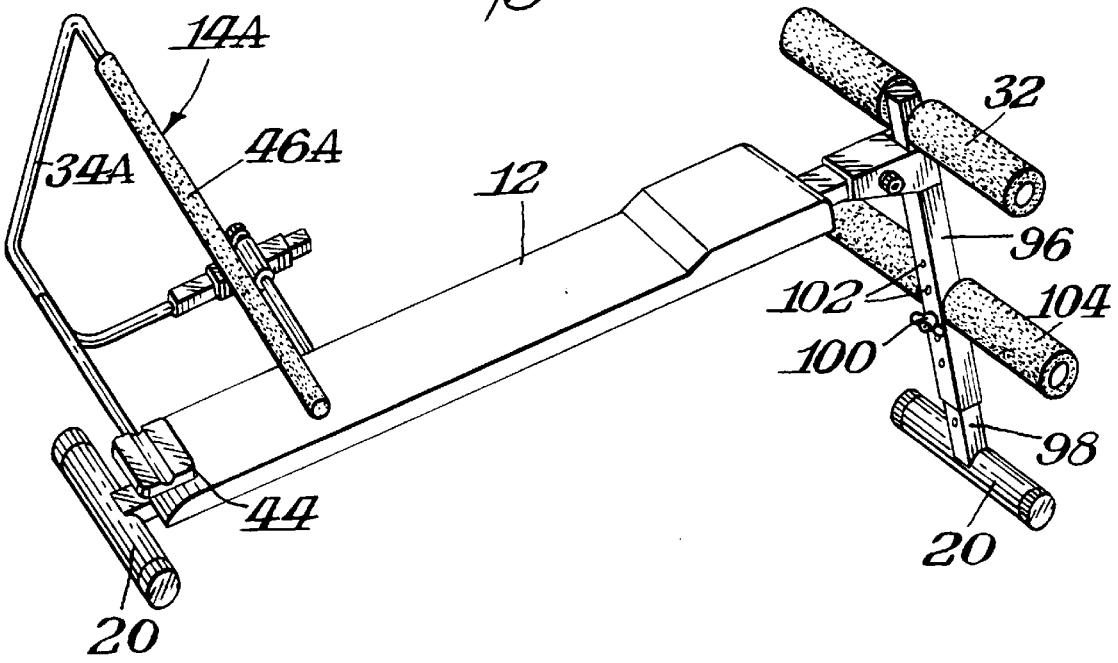
FIG. 14 is a perspective view of yet another combination exercise device in accordance with this invention.

In order to facilitate the user sliding under bar 88, rocker 14 is preferably of one-sided frame construction such as shown in FIGS. 4 and 14, thereby leaving an open side. If desired bar 88 may be vertically adjustably mounted to frame 34. FIG. 12 illustrates frame 34 to have telescopic tube sections to which device 86 is mounted. Thus, the bar could be initially raised until the user slides into position and then the bar 88 could be lowered for optimizing its operative location.

FIG. 14 illustrates a variation of the invention wherein the slant board 12 includes a combined elevating and cross member structure. As shown therein the elevated end of slant board 12 has a stabilizing leg 20 which would rest on the floor in the same manner as the stabilizing leg 20 at the other end of the slant board 12. The elevating mechanism would include an outer member 96 and an inwardly telescoped member 98 with the vertical positioning between the two being controlled by locking member 100 disposed in selected holes 102. A cross member 32 is provided at the top of the elevating mechanism disposed above the upper surface of the inclined support. A further cross member 104 is located below the surface of the support for various optional exercises.

FIG. 14 also illustrates the form of rocker 14A shown in FIG. 4 wherein the frame 34A is located at only one side of the slant board.

Figure 15:
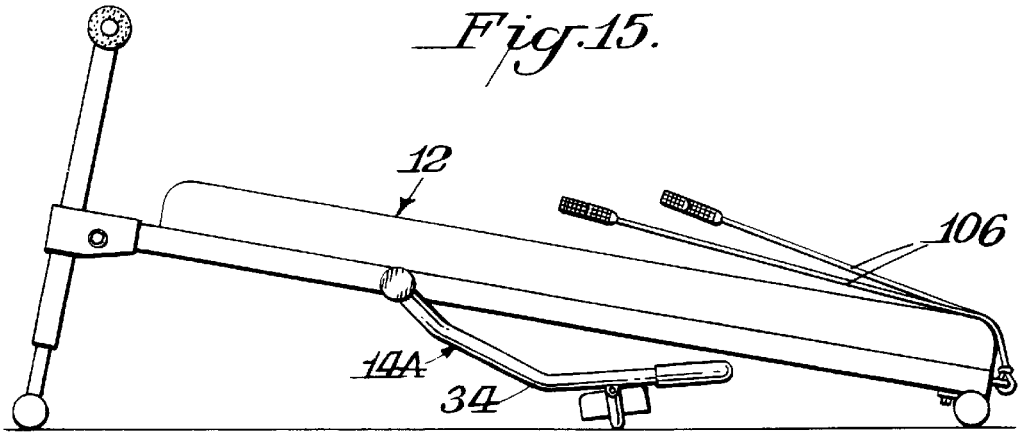
FIG. 15 is a side elevational view of a further combination exercise device in accordance with this invention.

FIG. 15 illustrates a further variation of the invention wherein the frame 34 may be pivoted below slant board 12 during periods of non–use. This could be accomplished by either mounting the rocker 14 close enough to one end of the slant board so that it could be rotated completely around from above to below the slant board or by making the length of frame 34 extendable to provide sufficient clearance to pivot completely around to the opposite side of the slant board. In order to pivot the frame 34, it might first be necessary to contract or temporarily detach the elevating structure at the upper end of board 12.

As shown in FIG. 15 resistance cords 106 are provided at one end of the slant board. The resistance cords could be placed between the thighs or feet or lower legs or ankles during various exercises.

It is to be understood that the combination exercise device may be used with the user's head at the upper end or at the lower end of the slant board depending upon the particular exercise being done.

Figure 16:
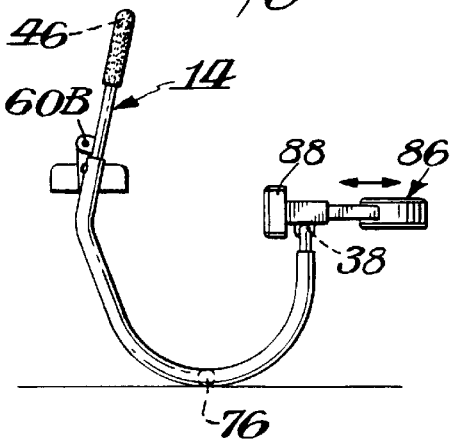
FIG. 16 is a perspective view of an abdominal rocker that may be used with various forms of slant boards in accordance with this invention.

FIG. 16 shows a rocker 14 which is expandable in width so as to fit over various sizes of slant boards or simply provide a wider rocker when the rocker is used alone. This is accomplished by making the grip member 46B and the neck or head rest rod 60B and the interconnecting frame rod 38 expandable such as being telescopic members. In the embodiment shown in FIG. 16 the abdominal flex unit 86 is also included and would have an expandable connecting rod 88.

Figure 17:
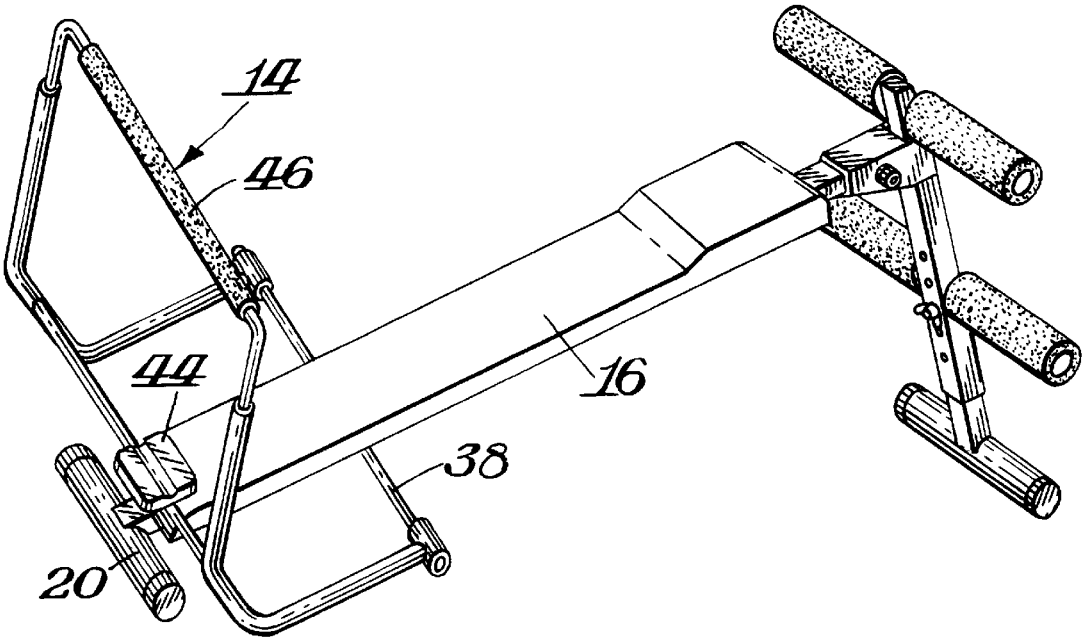
FIG. 17 is a perspective view of yet another form of combination exercise device in accordance with this invention.

The various embodiments previously described show the rocker 14 to be mounted directly to and thus supported by the slant board 12. FIG. 17, however, illustrates a variation of the invention wherein there is no physical connection between the rocker 14 and slant board 12. Rather, in the embodiment shown therein the cross member 38 is located beneath but out of contact with the support 16, while the neck rest or head rest 44 and grip section 46 would be located above support 16.

In its broad aspect the invention consists of combining an abdominal rocker and a slant board. Preferably the two units are detachably mounted together so that either unit could be used individually or both could be used in combination. While it is preferable to mount the rocker directly to the slant board, as shown in FIG. 17 there need be no physical connection and portions of the rocker could actually be below the slant board.

Figure 19:
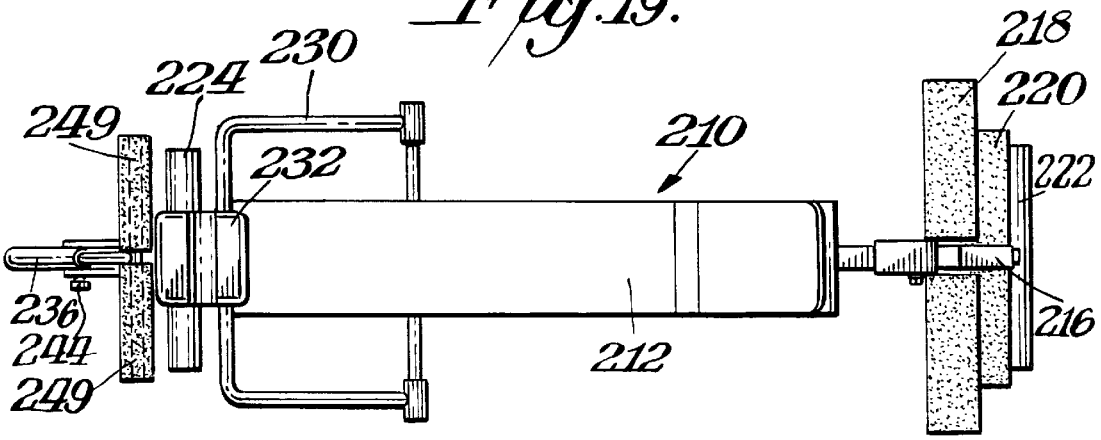
FIG. 19 is a top plan view of the combination slant board and abdominal rocker shown in FIG. 18.
Figure 18:
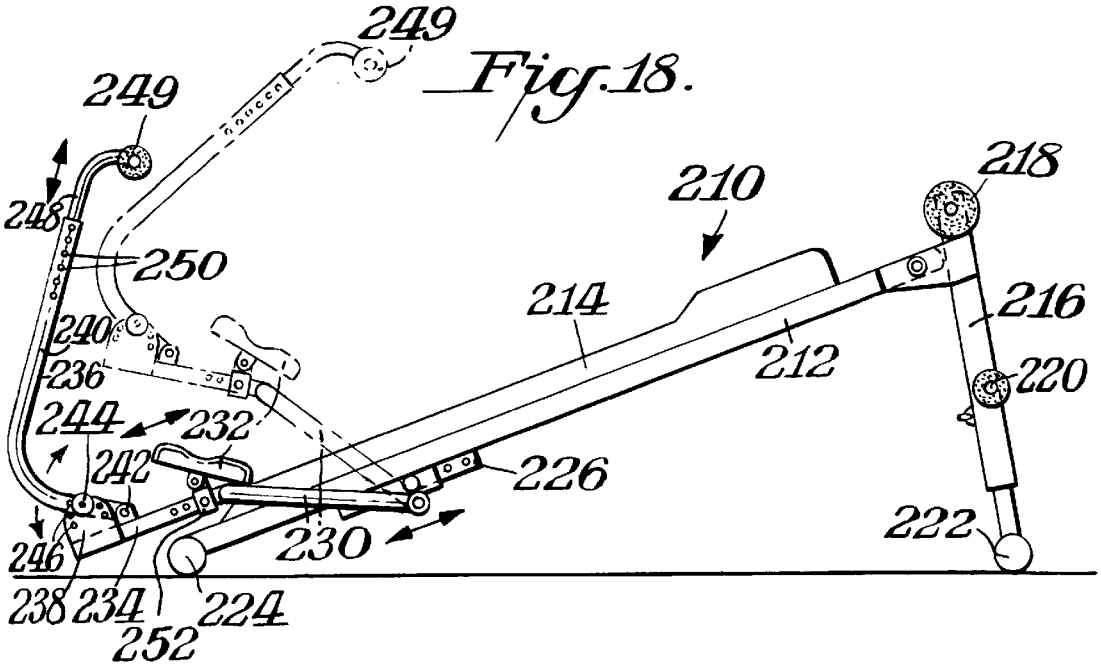
FIG. 18 is a side elevational view of a further combination slant board and abdominal rocker of this invention.
Figure 21:
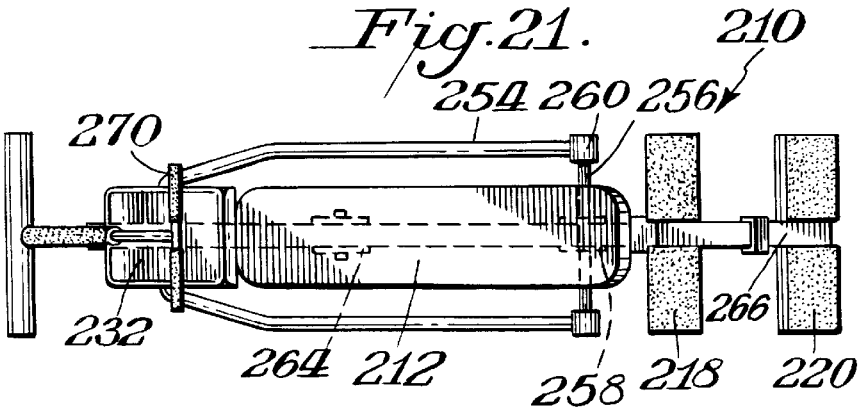
FIG. 21 is a top plan view of the slant board and abdominal rocker shown in FIG. 20.

FIGS. 18–19 illustrate a combination exercise device 210 which includes a slant board 212 having a padding 214 on its upper surface. One end of the slant board 212 is elevated by adjustable elevating mechanism 216 and may include various foot engaging members 218,220 as previously described. In addition, a stabilizing leg 222 is in contact with the floor. The opposite end of the slant board 212 would be disposed against the floor by means of its foot 224.

A bracket structure 226 is mounted to and below slant board 212. The bracket structure receives the support assembly 230 to which the head rest 232 is pivotally mounted by means of a pivot structure in the manner previously described.

In accordance with this invention a bracket member 234 is secured to the support structure 230 in the general area of the head rest 232. The rocker 236 is mounted to bracket 234. Preferably, an adjustable angle plate 238 is secured to bracket 234 and the rocker 236 is mounted thereto.

As illustrated the rocker 236 is generally of T-shape in that it includes a vertical base member 240 and terminates in outwardly extending arms 249 which are preferably padded.

The lower end of base member 240 is bent inwardly for engagement with plate 238 and bracket 234. In this respect, the end of base 240 has a pivot pin 242 for pivotal engagement with bracket 234. A knob 244 extends through one of a series of holes 246 in plate 238 for engagement in a corresponding hole in base member 240. Preferably a pair of such plates 238 is provided so that the knob can extend completely through one plate and the base member 240 and then into or through the opposite plate.

With the above structure it is possible to pivot the rocker back and forth or to lock the rocker in a fixed condition. It is also possible for storage purposes to completely rotate the rocker and head rest until those components are moved into contact with the slant board to make a compact unit. FIG. 18 shows the rocker in phantom in an intermediate position.

Preferably the height of rocker 236 can be adjusted by telescoping an inner tubular member 248 into base member 240 and by utilizing a spring pin or any other fastener disposed in a selective opening 250 to control the height or degree of extension of inner member 248 from base member 240.

FIG. 18 also illustrates the mounting of headrest 232 to slide back and forth on bracket 234 by means of collar 252 around bracket 234. Bracket 234 and collar 252 are preferably of conforming cross-sectional shape such as both being round, square etc. It is thereby possible to not only pivotally mount the headrest 232 but also to adjust its longitudinal position with respect to the slant board.

The mounting of rocker 236 to slant board 212 is such that the rocker 236 can also be completely removed for periods of non-use such as when the slant board is being used or when the slant board and the rocker are both being stored.

The advantage of rocker 236 is that by forming the rocker as a generally T-shape results in the elimination of the outer tubular members which are generally found with abdominal rockers.

The device of this invention has a number of distinct advantages particularly relating to maximizing comfort and being able to be customized to various diverse types of users. By providing a neck rest that can slide longitudinally, the neck rest can be adjusted to accommodate the particular distance between the neck and shoulders. By having the rocker 236 adjustable longitudinally with respect to the foot engaging members 218,220, different leg lengths can be accommodated. By having the T-bar vertically adjustable, different arm lengths can be accommodated. By having adjustable heights for the slant board, the resistance can be adjusted. When the user pivots back, there is full extension of the lower abdominals to reach the cross piece, thus stretching the abdominals. The arc for the rocker can be customized for abdominal exercise regardless of different sizes of individual users.

FIGS. 20–25 show a modified form of combination slant board and abdominal rocker 210. As shown therein the headrest 232 conforms more closely to the shape of the user's head for greater comfort. The rocker 236 is of more simplified structure than in FIGS. 18–19. Rocker 236 would be adjustably mounted to plates 238 by having a pivot pin 242 extend through the plates. A series of, for example, three holes 246 are provided in plates 238 for engagement in a second pin through one of the holes and an aligned hole in the other plate. In the position shown in FIG. 20 the center hole 246 is engaged so that the rocker 236 is in its intermediate position. Other positions would be offset 450 in each direction.

Figure 20:
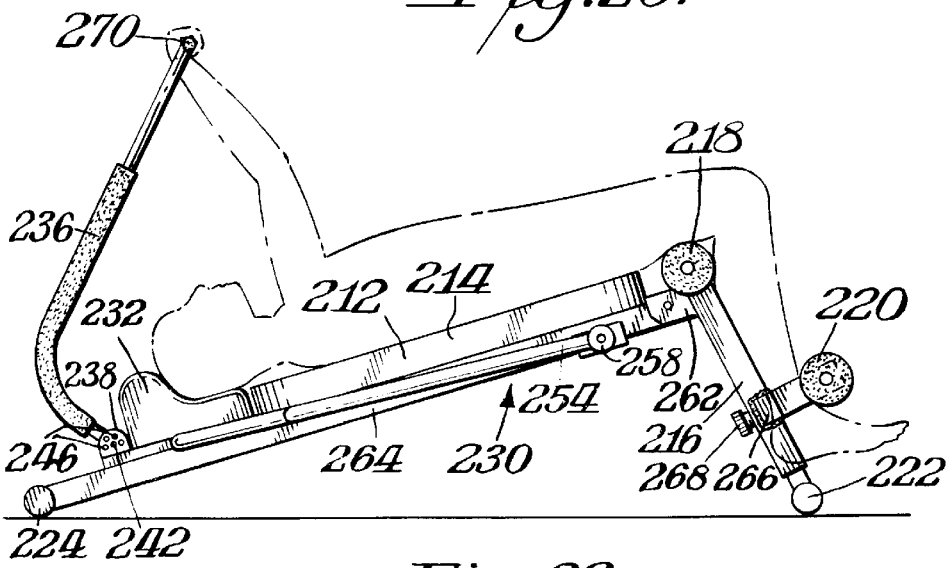
FIG. 20 is a side elevational view showing a still further modified form of slant board and abdominal rocker in accordance with this invention.
Figure 24:
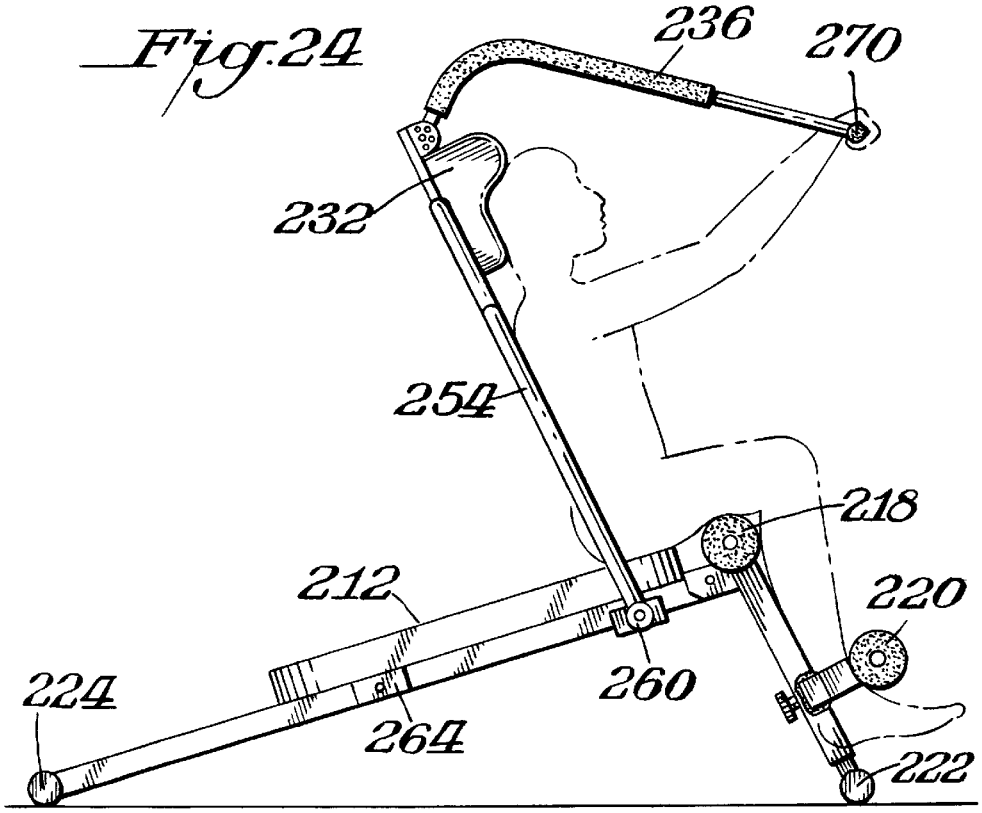
FIG. 24 is a side elevational view of the combination slant board and abdominal rocker shown in FIGS. 20–23 in a different stage of use.
Figure 25:
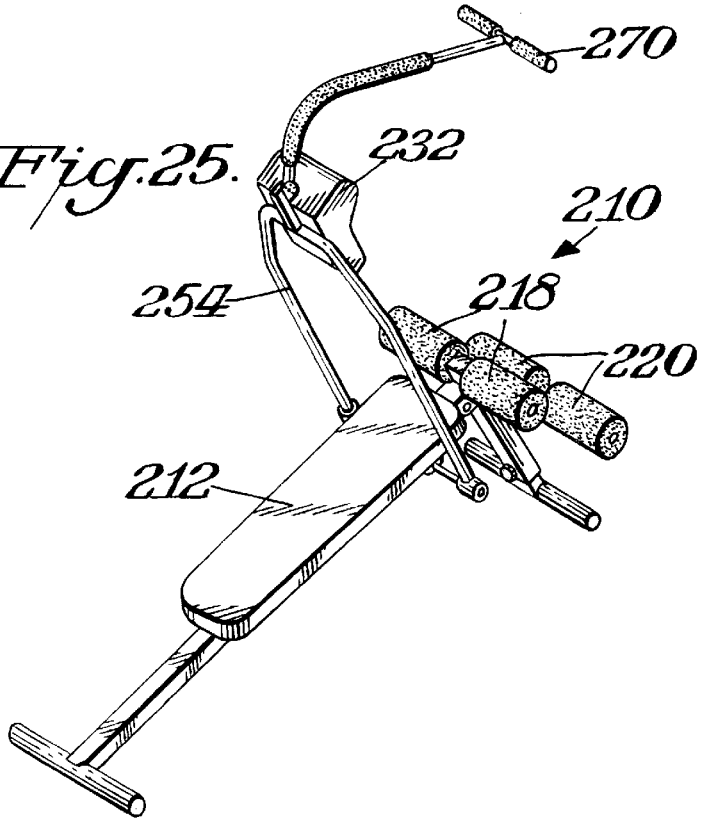
FIG. 25 is a perspective view of the combination slant board and abdominal rocker shown in FIGS. 20–24.

In this embodiment the support assembly 230 includes a pair of elongated support rods 254 pivotally mounted on each side of the slant board 212. Such pivotal mounting could be achieved in any suitable manner such as by disposing a shaft 256 through a pair of brackets 258 connected to slant board 212. A connector 260 is rotatably disposed around shaft 256 and is connected to the support bars 254. Thus, the user could be disposed in various positions. If desired, locking structure could be provided for connectors 260, 260 to lock rods 254, in any of the various angular positions. FIG. 20, for example, shows the fully inclined position while FIG. 24 shows a more upright condition. The brackets 258 may be detachably mounted to slant board 212 to detach the rocker 236 during storage conditions.

The foot exercise mechanism which includes foot bar 218 and foot bar 220 as well as stabilizing leg 222 may be connected to a mounting bracket 262 which fits over an extension of slant board 212 so that during storage conditions the foot assembly can be detached from the slant board by detaching U-shaped bracket 262.

The padded portion 214 of slant board 212 may also be detachably mounted to slant board 212 by brackets 264.

FIG. 20 illustrates an adjustable positioning mechanism for foot bar 220 which includes, for example, a bracket 266 mounted to elevating assembly 216 with the vertical position being controlled by knob 268 through the use of, for example, a pin on the knob extending through a series of holes on assembly 216 for engagement with bracket 266.

Figure 22:
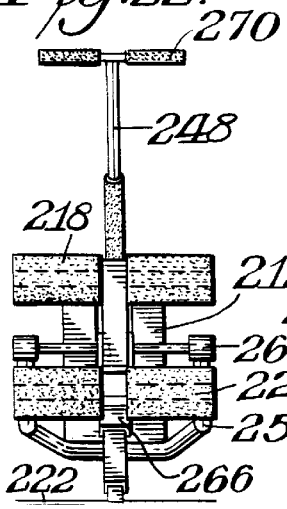
FIGS. 22 and 23 are right end and left end elevational views of the combination slant board and abdominal rocker shown in FIGS. 20–21.
Figure 23:
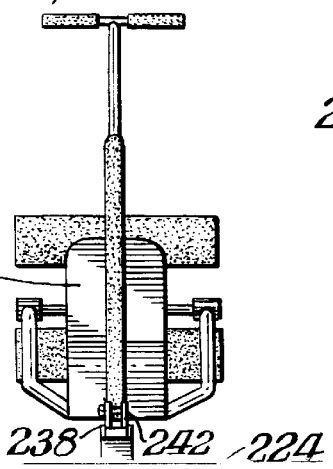
Figure 26:
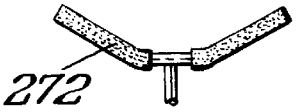
FIG. 26 is a top plan view of an alternative form of hand grip usable in the combination slant board and abdominal rocker of this invention.

FIGS. 22–23 show the handles to extend perpendicularly from rocker member 248. FIG. 26 shows an alternative where the handles 72 are bent forward. Handles 270 or 272 would be padded as would the embodiment of FIGS. 17–18.

It is to be understood that various features shown in the embodiment of FIGS. 18–19 and in the embodiment of FIGS. 20–26 may be used in other embodiments including the various embodiments of FIGS. 1–17.

The exercise can also be enhanced by offering resistance to leg raising by the user. This can be accomplished in various ways, such as attaching weights to the legs of the user or mounting elastic bands to the legs of the user with the bands anchored at an elevation below the legs.

The invention could be practiced where the rocker is structured to attach to only one specific slant board. Alternatively, and preferably, however, the rocker should be capable of attachment to various types of benches or slant boards. Similarly, the slant board could be structured for attachment or use with only one specific abdominal rocker. Alternatively, the slant board could be structured for attachment to different types of rockers.

Any suitable manner of mounting of the rocker and slant board may be utilized such as grooves, tracks, pivots, pins/holes, clamps/clips, screws sliding onto pressure fit or dropping onto or over structure. The mount for the rocker may have only one position, but preferably could be in a number of selected positions.

The invention could be practiced with various types of exercises. The preferred, but not sole intent, however, is to exercise the abdominal and back muscles. The invention could be also used for exercising the arms, chest, hips and legs. Typical abdominal exercises could include crunches, sit-ups (either flat or inclined), rocking sit-ups (either flat or inclined) and bent/straight leg lifts. Typical back exercises include leg lifts with or without resistance, hyper extensions, backward rocking and rowing. Typical arm and leg exercises would include rowing, pushups, leg raises and leg pull downs. The invention may be practiced where the rocker is permanently attached to the slant board or preferably where it is detachable. Alternatively, the rocker or various components thereof could be repositioned to be located out of the way during periods of non-use. FIG. 15, for example, illustrates a fold down non-use position of the rocker.

It is to be understood that while various embodiments have been described having various features, the invention may be practiced utilizing features of different embodiments with each other within the spirit of this invention.

What is claimed is:

1. A combination exercise device comprising a slant board and an abdominal rocker, said slant board comprising a rigid body support having a first one end and a second other end, elevating structure connected to said one end for elevating said one end above said other end to incline said body support, said abdominal rocker including a frame having a base section, said base section pivotally mounted adjacent to said body support, said frame including a grip section spaced from said base section, a neck rest mounted to said frame between said base section and said grip section, said grip section and said neck rest being located above said body support, said base section being U-shaped with a leg on each side of said body support and an intermediate connecting member connected to said rocker including a single base assembly having a lower end mounted to said connecting member and an upper end, cross arms extending outwardly from said upper end whereby said single base assembly and said cross arms form a generally T-shape, and said grip section being on said cross arms.

2. The device of claim 1 wherein said neck rest is pivotally mounted to said frame to be selectively moved to an inactive condition during non-use of said rocker.

3. The device of claim 1 wherein said base assembly is pivotally connected to said connecting member of said base section.

4. The device of claim 3 including a rocker bracket mounted to said connecting member of said base section and extending outwardly from said connecting member in a direction opposite the direction of said legs, an angle plate mounted to said rocker bracket, and said lower end of said base assembly being selectively mounted to said angle plate at one of a series of locations to selectively mount said base assembly at a predetermined angle with respect to said base section.

5. The device of claim 4 wherein said neck rest is slidably mounted on said rocker bracket to adjust the longitudinal positioning of said neck rest with respect to said body support.

6. The device of claim 3 wherein said base assembly is vertically adjustable in length.

7. The device of claim 3 wherein said rocker is movable to a position directly against said body support for compact storage during periods of non use.

8. A combination exercise device comprising a slant board and an abdominal rocker, said slant board comprising a rigid body support having a first one end and a second other end, elevating structure connected to said one end for elevating said one end above said other end to incline said body support, said abdominal rocker including a frame having a base section, said base section pivotally mounted adjacent to said body support, said frame including a grip section spaced from said base section, a neck rest mounted to said frame between said base section and said grip section, said grip section and said neck rest being located above said body support, said base section including a pair of base section members each of which is mounted on a shaft to said body support, and a base assembly pivotally mounted to said base section.

9. The device of claim 8 including a locking member for locking each of said base sections to said shaft to adjust the angular orientation of said base sections to said body support.

10. The device of claim 9 wherein a single shaft connects both of said base sections to said body support by passing through a support bracket mounted to and below said body support, and said support bracket being detachably mounted to said body support to permit the selective detachment of said rocker from said body support.

11. The device of claim 8 wherein said elevating structure comprises an elevating member having an upper end mounted to said body support and a lower end for being mounted on a support surface, a foot exercise mechanism mounted to said elevating member, said foot exercise mechanism including spaced apart foot bars extending outwardly from said elevating member, a stabilizing bar mounted to said lower end of said elevating member, said body support having an extension on its lower surface, and said elevating member having a mounting bracket detachably mounted to said extension whereby said elevating structure and said foot mechanism and said support bar may be detached from said body support by detachment of said mounting bracket from said extension.

12. The device of claim 11 wherein one of said foot bars is slidably mounted on said elevating member to adjust its position on said elevating member.

13. The device of claim 1 wherein said elevating structure comprises an elevating member having an upper end mounted to said body support and a lower end for being mounted on a support surface, a foot exercise mechanism mounted to said elevating member, said foot exercise mechanism including spaced apart foot bars extending outwardly from said elevating member, a stabilizing bar mounted to said lower end of said elevating member, said body support having an extension on its lower surface, and said elevating member having a mounting bracket detachably mounted to said extension whereby said elevating structure and said foot mechanism and said support bar may be detached from said body support by detachment of said mounting bracket from said extension.

14. The device of claim 13, wherein one of said foot bars is slidably mounted on said elevating member to adjust its position on said elevating member.

* * * * *